United States Patent [19]

Sweet

[11] Patent Number: 5,027,457

[45] Date of Patent: Jul. 2, 1991

[54] COVER FOR PILLOW WITH APPENDAGES

[76] Inventor: Dorothy Sweet, 15317 Crossdale, Norwalk, Calif. 90650

[21] Appl. No.: 476,963

[22] Filed: Feb. 7, 1990

Related U.S. Application Data

[63] Continuation-in-part of Ser. No. 344,254, Apr. 27, 1989, abandoned.

[51] Int. Cl.[5] ..... A47G 9/00

[52] U.S. Cl. ..... 5/437; 5/434; 5/490; 446/369; 446/390; D6/599; D6/601

[58] Field of Search ..... 5/434, 436, 437, 441, 5/490, 431; 446/369, 72, 390; D6/597–601

[56] References Cited

U.S. PATENT DOCUMENTS

| | | | |
|---|---|---|---|
| D. 174,996 | 6/1955 | Peters | D6/601 |
| 2,540,701 | 2/1951 | Thorpe | 446/369 |
| 2,961,668 | 11/1960 | Hayes | 5/436 |
| 3,840,916 | 10/1974 | Jennings | 5/432 |
| 4,197,604 | 4/1980 | Nakamura | 5/437 |
| 4,790,042 | 12/1988 | Reich | 5/437 |
| 4,887,326 | 12/1989 | O'Brien et al. | 5/490 |
| 4,889,512 | 12/1989 | Burnett et al. | 5/490 |

OTHER PUBLICATIONS

"Luv Dolly", an ad on page 306 of the Feb. 1983 issue of Playthings.

*Primary Examiner*—Alexander Grosz

[57] ABSTRACT

In a pillow having extended arms and legs, the arms are semi-circular and of sufficient length to enable them to extend either around the neck or extend around the torso of a human body and enable the pillow to cling to the body and support the neck or back. The pillow, and/or an external pillow case or removable cover, can be decorated to make the pillow an ornamental design, or caricature, as of a person or animal. The cover can simulate an article of clothing and is adapted to permit the arms and legs of the pillow to retain their initial appearance.

12 Claims, 3 Drawing Sheets

COVER FOR PILLOW WITH APPENDAGES

DESCRIPTION OF RELATED APPLICATIONS

This application is a continuation in part of my application Ser. No. 07/344,254, filed Apr. 27, 1989 now abandoned, the entire disclosure of which, as filed, is hereby incorporated herein by this reference.

BACKGROUND OF THE INVENTION

It is frequently desirable to have a bed pillow which, by itself, can hold onto a person, while the person moves around. For example, in hospitals and nursing homes, a person may need to sit on a pillow, and it may be desirable for the person to move the pillow from place to place. A person in a wheel chair may wish to have a pillow which can be placed behind their neck when they are in the wheel chair. Children frequently carry a pillow from room to room. The prior art has utilized straps to enable the pillow to cling to the person.

With utilitarian items, such as pillows, it is also frequently desirable that they be decorative. Pillows or pillow cases have often been painted with the features of animals or human caricatures. For example, photographs of the faces of movie stars have been printed on pillows or pillow cases.

The present invention provides an improved means of enabling a pillow to cling to the human body, while at the same time providing fanciful ornamental designs, such as caricatures of persons, or of animals, and can include removable covers, which resemble clothing.

BRIEF DESCRIPTION OF THE INVENTION

The present invention relates to an article of manufacture comprising a pillow with extended arms and legs, the arms being substantially semi-circular and of sufficient length to enable the pillow to extend around either the neck or torso of a human body. The article is adapted to permit it to cling to the body, preferably as an ornamental design or caricature where the arms are substantially longer than the legs.

The arms can terminate in a mitten shape, or in a hand with fingers. Preferably, the pillow and arms are stuffed with a resilient material, such as feathers, polymeric foam, and natural or synthetic fibers. The article can also be inflated with a gas or liquid, when the outer surface is gas or liquid impermeable. The article can be molded from polymer foam as a unit, but it is more preferred that such foams be comminuted and used as stuffing.

Preferably, the arms are substantially firm and adapted to cling to a person without the need of a fastening device. However, it is sometimes desirable to include on the arms a fastening device to enable the arms to attach to themselves, thereby being able to more firmly remain upon a person during movement.

The fastening device can be buttons, hook and eye fasteners, e.g., Velcro® snaps, peelable adhesives or the like.

Preferably the article is of a flesh-colored fabric, but it could be any color. As an ornamental design, at least one surface of the pillow can be decorated with facial features, such as caricatures of a man, woman, or child, or animal (such as a bear, cat, or dog).

Preferably, the pillow is substantially in the shape of a bed pillow. The pillow can be comprised of two rectangles of fabric which are held together by seams and are filled with a stuffing material.

The invention also relates to removable covers having a sack or pillow shape, which resemble clothing and which have provisions for retaining the appearance of the legs and the appearance and functionality of the semi-circular arms.

In a preferred embodiment at least one side or surface of the cover is imprinted with a caricature, e.g., a face or other designs.

Preferably, the fabric surface has a texture which assists in enabling the article to cling to a person (e.g., although satin is decorative, a rougher fabric, such as a cotton/acrylic poplin, will more readily cling to a person.

DETAILED DESCRIPTION OF THE PREFERRED EMBODIMENT

Figure 1:
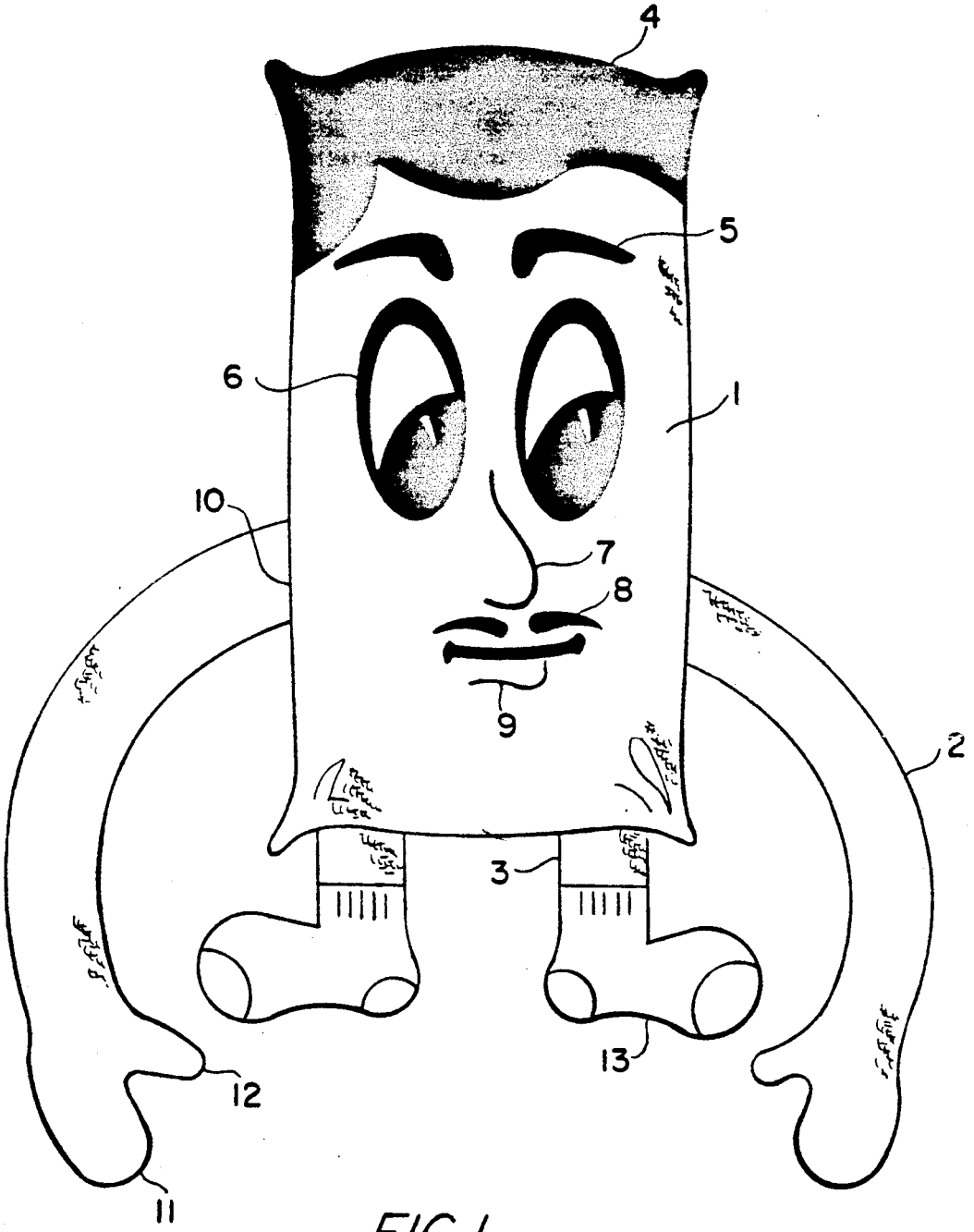
FIG. 1 illustrates an embodiment of the invention wherein the pillow (1) is printed with a substantial caricature of a man's face and where the arms (2) are semi-circular and much longer than the legs (3).
Figure 2:
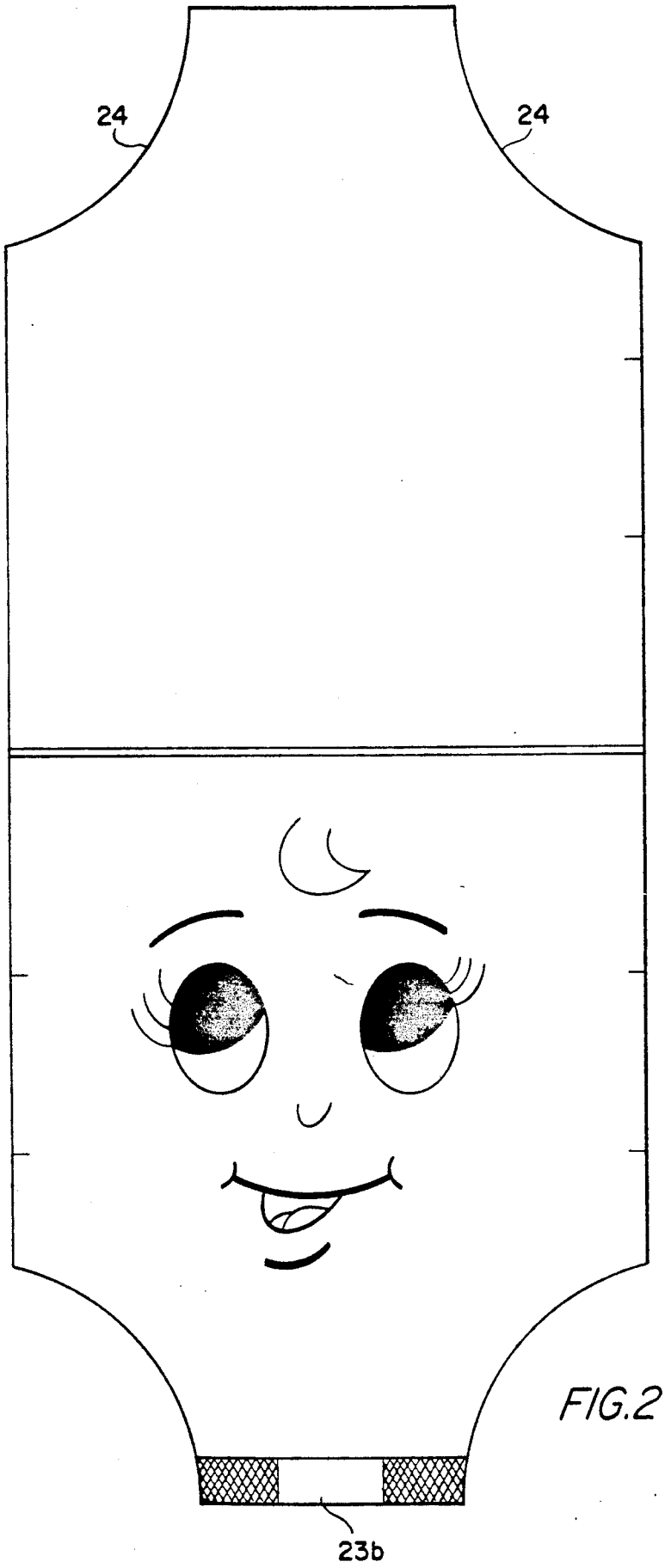
FIG. 2 illustrates the front portion, prior to fastening, (by hook and eye fasteners, e.g., 23*b*) of a cover for the pillow, which is substantially in the shape of clothing and which is adapted to preserve the appearance of the legs (e.g., by an open, curved diaper-like bottom section) and the appearance and functionality of the arms of the article.
Figure 3:
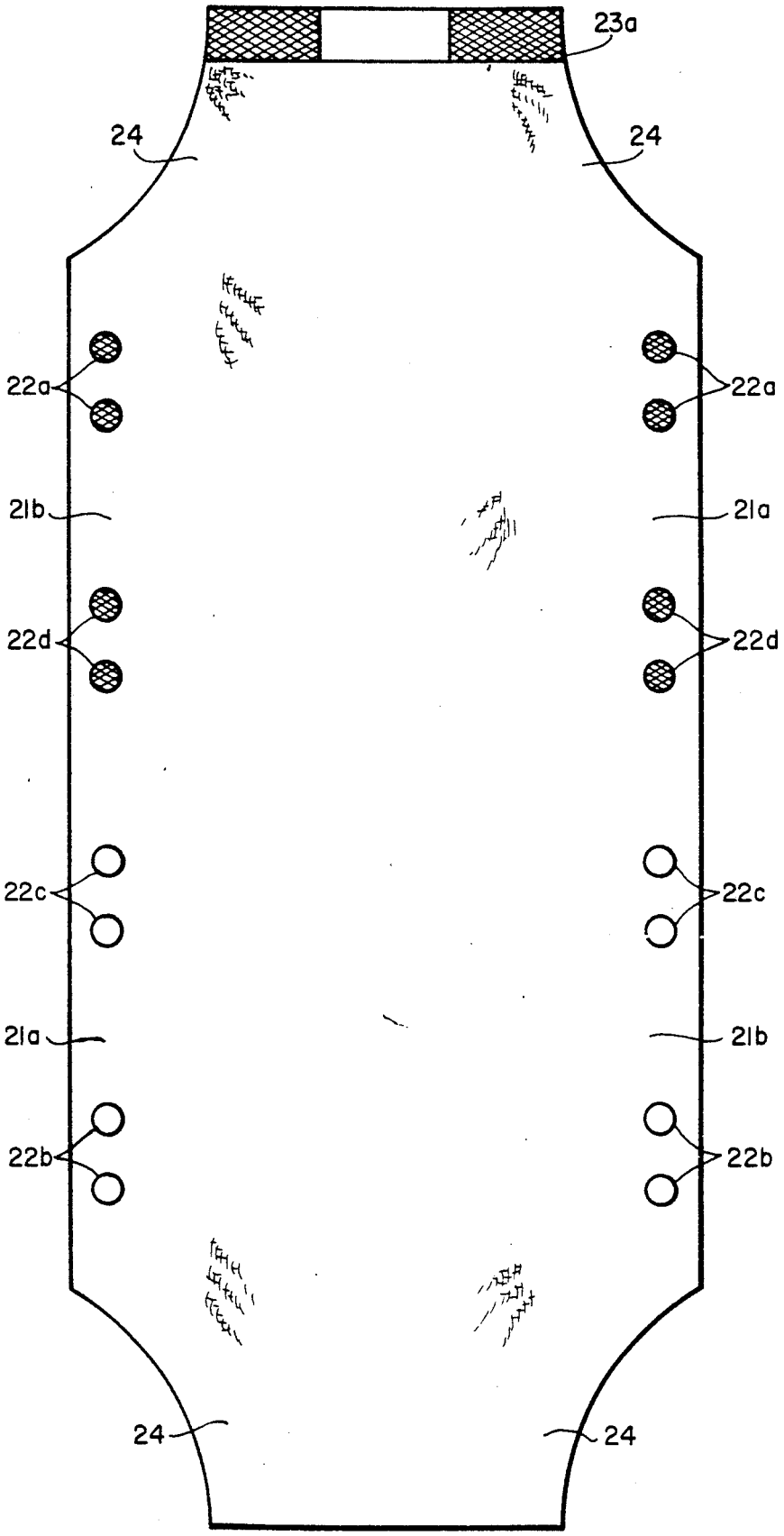
FIG. 3 illustrates the reverse side of the cover of FIG. 2, and shows hook fasteners (22*a*, 23*a*, 22*d*,) which, with the corresponding eye fasteners 23*b* (of FIG. 2), 22*c* and 22*b*, form a substantial shape of a pillow cover, with openings (e.g, at 21*b*) for the arms and for the legs (at 24), can hold the cover in the substantial configuration of a pillow case when mated.

FIG. 1 illustrates one preferred embodiment of the invention where the pillow (1) comprises a body portion which is assembled by sewing two rectangular pieces of cotton/acrylic blend poplin fabric of about 22 inches in length by about *17* inches in width, to provide a sack approximately in the shape and size of a pillow case for a full size bed.

The material, which is flesh in color, has previously been printed with a caricature of a human face, namely a black section simulating hair (4), two inverted V-shapes to simulate eye brows (5), and caricatures of eyes (6), a nose (7), mustache (8), and chin line. (9).

The reverse side of the pillow shape can be a caricature of the reverse side of the head and back side of a man.

The pillow case shape (which has been joined by seams on three of the four edges), is then filled to the desired thickness; i.e., about *7* inches, with a suitable filling material, such as fibers, either natural or synthetic, or comminuted foam (i.e. polyester foam).

Approximately *8* inches from the top of the printed hairs, is the start of a sewn seam (of about two inches) (10), connecting an arm-like appendage (2) composed of the same fabric and stuffing material, the base extending about 4 and ½ inches down the seam.

The arm-like appendage (2) is substantially in the shape of a semi-circle of about 18 inches in diameter and terminates in a mitten-like shape with an inwardly extending thumb (12).

A similar arm is sewn to the opposite side, said arms being of sufficient length and of such unusual shape as to interlock when extended around the neck or torso of a person and of sufficient weight and firmness to enable the interlocked arms to cling to the person and permit carrying of the article without the use of a person's hands or additional fastening devices.

This preferred embodiment, wherein the fabric is a cotton/acrylic blend poplin, does not require external fasteners on the arms to enable the arms to maintain a locking position about a person. However, where the fabric is slick, such as satin or silk or 100% polyester, it may be desirable to attach an external fastening device to the outer portion of the arms (i.e. the mitts), such as hook and pile fasteners (e.g. Velcro®, or hook and eyes, straps, buckles, buttons/holes, zipper fasteners, or the like.

To further promote the caricature of a man, the preferred embodiment has appended two leg-like members (3) which are sewn on the seam opposed to the painted head section of the body. The leg-like members are about 6 inches by about 2 and ½ inches in diameter, terminating in a foot-like member (13) of about 5 inches in length.

The resulting article is a caricature of a man and has substantially semi-circular arm-like appendages which can be interlocked to enable the article to cling to a person and be carried without assistance of the person's hands. Furthermore, the article can be used as a bed pillow, or as a seat cushion, or as a back support, as for a person in a wheel chair, or as a neck support, as for a person with a stiff neck, who can use the pillow to provide support to the neck while working in the kitchen, or going about the convalescent's chores, without having to hold the pillow.

FURTHER DESCRIPTION

The article is a novel, ornamental design, especially when it is a caricature of a person or animal. Other embodiments can be different in size, such as those adapted for the use of children, in shape, such as substantially oval or circular objects, or as caricatures of other objects, such as women, children and animals, and even fantasy figures such as space creatures. The cover (or "pillowcase") can also be a novel ornamental design, especially when at least one surface thereof contains a caricature, as of a face.

A unifying feature of all of these embodiments described in this example is the body of the caricature is substantially in the shape of a pillow or cushion and the arm-like appendages are substantially semi-circular and of sufficient length to enable them to encircle a child or adult for attachment thereto, without the use of hands or additional aids, such as straps, suspenders or belts.

The article can include means of emitting sound, such as a bell or voice box (e.g. a pull string or voice-activated tape player). Means (such as a string and pulley) can be included to enable one or more of the appendage to move.

Instead of stuffing a textile fabric with a filler, the article can comprise a non-permeable material, such as rubber, or an extruded plastic film with gas impermeable seams and constructed such that the entire object can be pneumatically or hydraulically filled with air, helium, water, or other fluid. In such an inflatable article, the inner structure can be cellular to provide internal support and improve comfortableness, as a pillow. The article can also include means of heating or cooling to enable it to be used as a hot water bottle or a cold pack.

In an animal caricature, the appendages need not be shaped like arms but, as an elephant, could be shaped like tusks. For a bird-like caricature, the appendages could be wings or claws or, for a cat, whiskers. In animal caricatures, a centrally located appendage can be included, such as an elephant's trunk, or the nose of an anteater.

The article can be fitted with additional outer removable coverings (i.e. clothes) which can be in the form of a pillow case (i.e., a pillow slip). The clothes (or pillow case) can protect the article, in much the same way that a pillow case protects a pillow from soiling, too frequent washings, etc., and are usually less bulky and more easily washed and dried than the article itself. The clothes or case adds to the comfortableness and ornamentation of the item, and preferably are made of a soft material, such as tee shirt or sweat shirt material, which is comfortable to touch and to lie upon. The clothes also add a decorative touch to the object, and can be painted with features in the same way as the pillow itself, or in a different manner. The look of the article can be varied or changed by means of a change of clothes or case.

The clothes or pillow cases can come with holes or sleeves which slip over the arms of the article and substantially cover most of the pillow section of the article, and can terminate in a V-shape on the bottom, as on a bathing suit. Fasteners, such as snaps, or hook and eye fasteners, or zippers can be used in a diaper-like fashion to connect the bottom of the case between the legs of the caricature of the person or animal. In some instances it may be desirable to have clothing that will cover fully, or partially, one or more appendages (and simulate stockings or gloves, etc.)

One preferred embodiment is an article of manufacture comprising a pillow with appendages substantially in the shape of arms, the shape of the arms being substantially semi-circular and of sufficient length to enable the pillow to extend around either the neck or torso of a human body and adapted to permit the article to cling to the body, said article also having additional appendages, substantially in the shape of legs, said arms being substantially longer than said legs and wherein said arms are substantially firm and adapted to cling to a person without the need of a fastening device From the above discussion of the preferred embodiments, and certain variations thereon, it can be seen that many obvious variations can be devised, and it is intended that such variations be within the scope of the attached claims.

What is claimed is:

1. A pillow comprising a body portion having appendages, extending from the body portion, substantially in the shape of arms and legs, the shape of the arms being substantially semicircular and of sufficient length to enable the pillow to extend around either the neck or torso of a human body and adapted to permit the article to cling to the body of a user, and a removable cover comprising a sheet with releasable fasteners at peripheral portions thereof, said sheet adapted to be folded to cover a substantial portion of the body portion, whereby when the releasable fasteners are interconnected, the cover is securely retained on the body portion and openings are provided in the peripheral portions of the cover, between said interconnected releasable fasteners, permitting the extending therethrough of said arms and legs.

2. The pillow of claim 1, wherein said arms terminate in a mitten shape.

3. The article of claim 1, wherein said pillow and said arms are stuffed with a resilient material.

4. The pillow of claim 3, wherein said resilient material comprises a member selected from the group consisting of feathers, polymeric foam, and natural or synthetic fibers.

5. The pillow of claim 4 wherein said arms are substantially firm and adapted to cling to a person without the need of a fastening device.

6. The pillow of claim 4, wherein said arms contain a fastening device to enable the arms to attach to themselves, thereby being able to more firmly remain upon a person during movement.

7. The pillow of claim 6, wherein said fastening device is selected from the group consisting of buttons, hook and eye fasteners, hook and pile fasteners, snaps, and peelable adhesives.

8. The pillow of claim 1, where at least one surface of said pillow is decorated with facial features, whereby the article is a substantial caricature of a man, woman, child, or animal.

9. The pillow of claim 1, wherein said pillow is substantially in the shape of a bed pillow, wherein said pillow is comprised of at least two substantially rectangular portions of fabric which are held together by seams and are filled with a stuffing material.

10. The pillow of claim 9, wherein said fabric has a texture which assists in enabling the article to cling to a person.

11. The pillow of claim 1, wherein said pillow is comprised of two substantially oval or circular portions of fabric which are bound together and filled with a stuffing material.

12. The pillow of claim 1, wherein at least one external surface of said cover contains a caricature of a face.

* * * * *